US006405374B1

(12) United States Patent
Giakas-Cano

(10) Patent No.: US 6,405,374 B1
(45) Date of Patent: Jun. 18, 2002

(54) BIB WITH SECURING DEVICE FOR SECURING ABOUT TORSO

(76) Inventor: Dawn Giakas-Cano, 321 Libourel Rd., South Plainfield, NJ (US) 07080

( * ) Notice: Subject to any disclaimer, the term of this patent is extended or adjusted under 35 U.S.C. 154(b) by 0 days.

(21) Appl. No.: 09/829,388

(22) Filed: Apr. 9, 2001

(51) Int. Cl.[7] ..... A41B 13/10
(52) U.S. Cl. ..... 2/49.1; 2/52
(58) Field of Search ..... 2/48, 49.1, 51, 2/52, 49.3, 111, 102, 46, 47, 49.2, 49.4, 50, 69; D2/861

(56) References Cited

U.S. PATENT DOCUMENTS

| | | | | | |
|---|---|---|---|---|---|
| 742,059 | A | * | 10/1903 | Peterson | 2/51 |
| 2,424,000 | A | * | 7/1947 | Shanker | 2/49.1 |
| 2,552,462 | A | * | 5/1951 | Sarvin | 2/49 |
| 2,672,614 | A | * | 3/1954 | Zimmerman et al. | 2/49 |
| 4,014,045 | A | * | 3/1977 | Moyer | 2/51 |
| 4,068,313 | A | * | 1/1978 | Goldman | 2/49.1 |
| 4,622,698 | A | * | 11/1986 | Heyman et al. | 2/48 |
| 4,850,051 | A | * | 7/1989 | Hodge | 2/52 |
| 5,220,692 | A | * | 6/1993 | Cox | 2/48 |
| 5,410,758 | A | * | 5/1995 | Dupont et al. | 2/51 |
| 5,640,717 | A | * | 6/1997 | Ray | 2/69 |
| 5,740,552 | A | * | 4/1998 | Smith | 2/52 |
| D398,140 | S | * | 9/1998 | Lion | D2/861 |
| 5,819,314 | A | * | 10/1998 | Jackson | 2/49.2 |
| 5,957,873 | A | * | 9/1999 | Allen | 2/102 |
| 6,141,798 | A | * | 11/2000 | Manning | 2/49.2 |
| D446,384 | S | * | 8/2001 | Cruz | D2/864 |

* cited by examiner

*Primary Examiner*—Amy B. Vanatta
(74) *Attorney, Agent, or Firm*—Walter J. Tencza, Jr.

(57) ABSTRACT

The present invention discloses an apparatus comprising a bib comprised of a neck portion, a body portion, a device for securing the neck portion around an individual's neck, and a device for securing the body portion around an individual's torso. The device for securing the body portion around an individual's torso may include a first extension and a second extension. The first extension and the second extension each may include an attachment device, which may be in the form of loops or hooks. The device for securing the neck portion around an individual's neck may include a first extension and a second extension. The first extension and the second extension each may include an attachment device, which may be in the form of loops or hooks. The first and second extensions each may have a first dimension which is at least one half the length of the body portion. The present invention also discloses a method including the steps of securing a neck portion of a bib to an individual's neck, and securing a body portion of a bib to an individual's torso. The step of securing the body portion of the bib to an individual's torso may include attaching a first extension connected to the body portion to a second extension connected to the body portion.

4 Claims, 2 Drawing Sheets

BIB WITH SECURING DEVICE FOR SECURING ABOUT TORSO

FIELD OF THE INVENTION

This invention relates to improved methods and apparatus for providing bibs particularly bibs for babies and small children.

BACKGROUND OF THE INVENTION

Typically in the prior art bibs for babies and small children are secured around the neck of the child. However, a body portion of prior art bibs tends to move or flop in front of a baby's face when the baby crawls, for example. This can not only cause unwanted debris such as half eaten food to fly in the baby's face but is also a health hazard since the baby's mouth can be smothered by the body portion of the prior bibs.

SUMMARY OF THE INVENTION

The present invention in one or more embodiments provides extensions which are connected to the body portion of a bib. The extensions can be wrapped around an individual's torso, such as a baby's torso, to prevent the body portion of the bib from flopping in front of the individual's face.

The present invention in one embodiment provides an apparatus comprising a bib comprised of a neck portion, a body portion, a device for securing the neck portion around an individual's neck; and a device for securing the body portion around an individual's torso. The device for securing the body portion around an individual's torso may also include a first extension and a second extension. The first extension and the second extension each may include an attachment device. The attachment device of the first extension may be loops of a VELCRO (trademarked) system while the attachment device of the second extension may be hooks of a VELCRO (trademarked) system.

The device for securing the neck portion around an individual's neck may include a third extension and a fourth extension. The third extension and the fourth extension each may include an attachment device, one of which may be loops of a VELCRO (trademarked) system while the other may be hooks of a VELCRO (trademarked) system.

The body portion of the bib may have a length and the first and second extensions each may have a first dimension which is at least one half the length of the body portion.

DETAILED DESCRIPTION OF THE DRAWINGS

Figure 1:
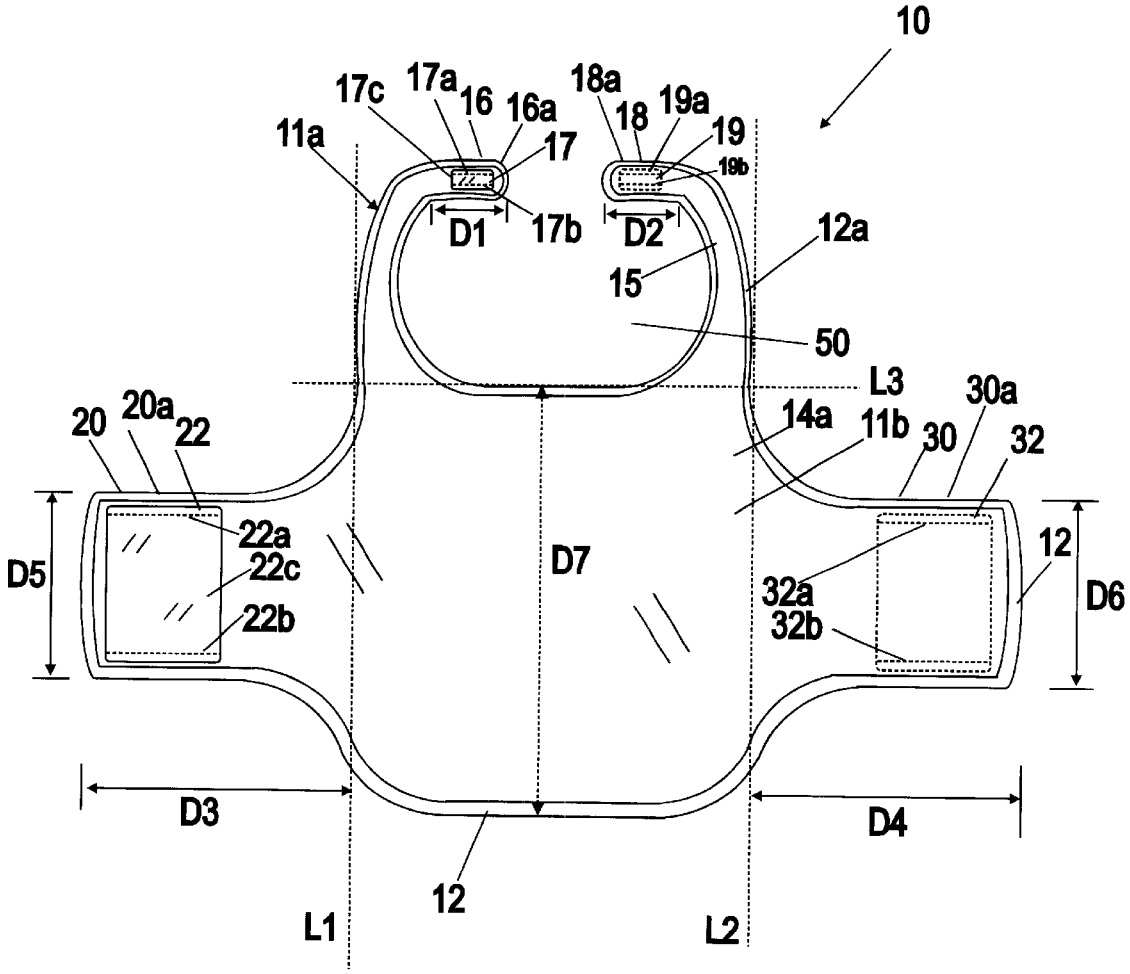
FIG. 1 shows a front view of a bib in accordance with an embodiment of the present invention.
Figure 2:
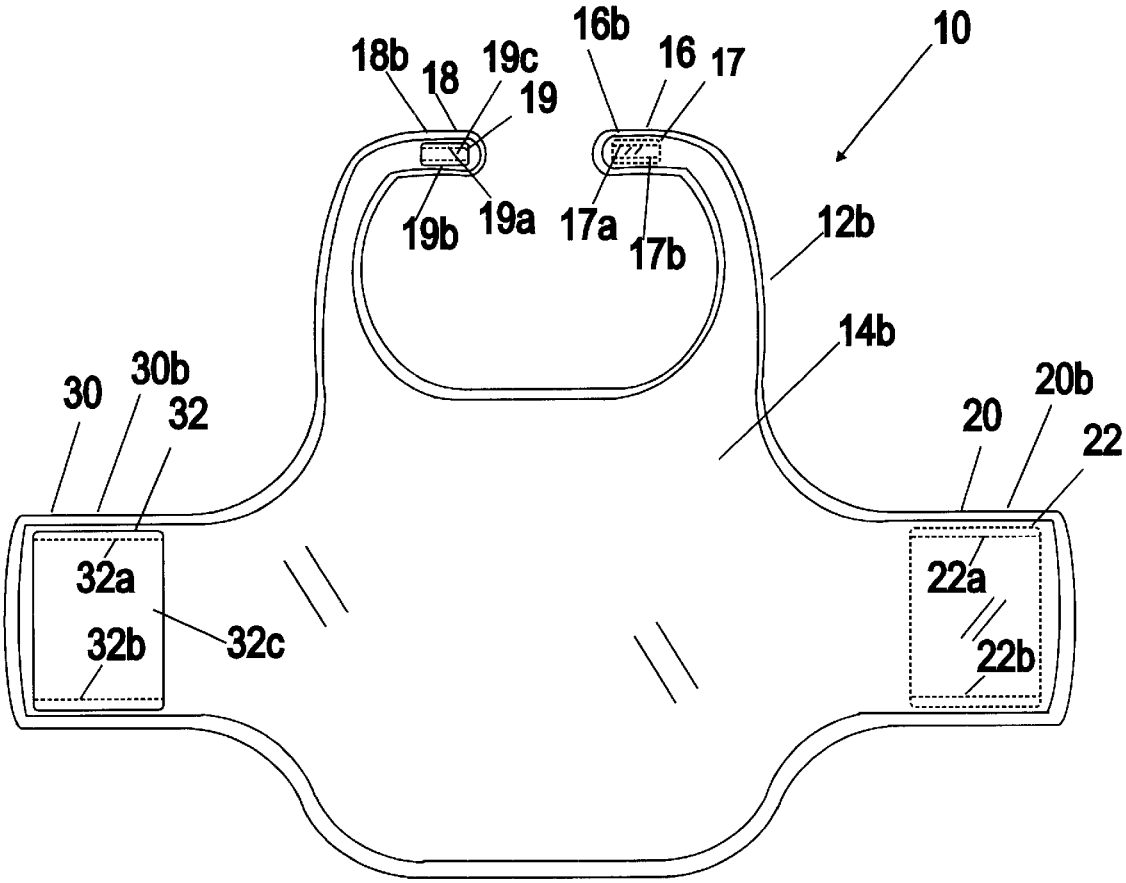
FIG. 2 shows a rear view of the bib of FIG. 1.

FIG. 1 shows a front view of a bib 10 in accordance with an embodiment of the present invention. FIG. 2 shows a rear view of the bib 10 of FIG. 1.

Referring to FIG. 1, the bib 10 includes a neck portion 11*a*, a body portion 11*b*, an extension 20 and an extension 30. The extensions 20 and 30, together, can be thought of as a device for securing the body portion 11*b* around an individual's torso. The neck portion 11*a* lies above the dashed line L3 and between dashed lines L1 and L2. The dashed lines L1, L2, and L3 are used for descriptive purposes and are not actually part of the bib 10. The neck portion includes portions 13 and 15 and extensions 16 and 18.

The body portion 11*b* lies below the dashed line L3 and between the dashed lines L1 and L2. The extension 20 extends outwards a distance of D3 from the body portion 11*b*, while the extension 30 extends outwards a distance of D4 from the body portion 11*b*. The distances of D3 and D4 may be the same and may each be four inches. The distances of D3 and D4 may vary based on the size of the person or child who will wear the bib 10.

The neck portion 11*a* of the bib 10 includes extensions 16 and 18. The extensions 16 and 18, together may be thought of as a device for securing the neck portion 11*a* around and to an individual's neck. Extension 16 may include an attachment device 17 which may be stitched onto extension 16 by stitches 17*a* and 17*b*. Extension 18 may include an attachment device 19 which may be stitched onto extension 18 by stitches 19*a* and 19*b*. Attachment device 19 is showed in dashed lines in FIG. 1 on side 18*a* of extension 18 because it would be located on side 18*b* of the extension 18 as shown in FIG. 2. Attachment device 17 is shown in dashed lines in FIG. 2 on side 16*b* of extension 16, because it would be located on side 16*a* of the extension 16 as shown in FIG. 1. The attachment device 17 may be a VELCRO (trademarked) portion. The attachment device 19 may be a VELCRO (trademarked) portion, which mates, connects or attaches to the attachment device 17. For example, attachment device 17 may be comprised of loops or hooks which attach or connect to hooks or loops of the attachment device 19. The attachment devices 17 and 19 could be strings or laces which could be tied together to connect extension 16 with extension 18 and to hold the bib 10 onto an individual's neck. The attachment devices 17 and 19 could be any other known attachment device.

The extension 16 extends out a distance D1 from the portion 13 of the neck portion 11*a*. Similarly the extension 18 extends out a distance D2 from the portion 15 of the neck portion 11*a*.

The extension 20 may be comprised of an attachment device 22 which may be stitched onto the extension 20 by stitches 22*a* and 22*b*. The extension 30 may be comprised of an attachment device 32 which may be stitched onto the extension 30 by stitches 32*a* and 32*b*. The attachment device 22 may be a VELCRO (trademarked) portion. The attachment device 32 may be a VELCRO (trademarked) portion, which mates, connects or attaches to the attachment device 17. For example, attachment device 22 may be comprised of loops or hooks which attach or connect to hooks or loops of the attachment device 32. The attachment devices 22 and 32 could be strings or laces which could be tied together to connect extension 20 with extension 30 and to hold the bib 10 onto an individual's torso. The attachment devices 22 and 32 may be any other known attachment device.

Attachment device 32 is showed in dashed lines in FIG. 1 on side 30*a* of extension 30 because it would be located on side 30*b* of the extension 30 as shown in FIG. 2. Attachment device 22 is shown in dashed lines in FIG. 2 on side 20*b* of extension 20, because it would be located on side 20*a* of the extension 20 as shown in FIG. 1.

In operation, the bib 10 is secured around an individual's neck by connecting attachment device 17 to attachment device 19 so that the surface 17*c* of the attachment device 17 shown in FIG. 1, contacts, connects and attaches to the surface 19*c* of the attachment device 19 shown in FIG. 2. When the bib 10 is properly secured the individual's neck is located in opening 50 shown in FIG. 1. The bib 10 can then be secured around an individual's torso by connecting attachment device 22 to the attachment device 32 so that the surface 22*c* of the attachment device 22 shown in FIG. 1, contacts, connects and attaches to the surface 32*c* of the attachment device 32. Although not preferred the bib 10 could also be placed on an individual by first securing the bib 10 around the individual's torso and then securing the bib 10 around the individual's neck.

The present invention in one or more embodiment is particularly useful for bibs for babies. The extensions 20 and 30, and the process of securing the bib to the baby's torso prevents the bib from covering the baby's face when the baby is crawling or lying on his or her back. Very young infants can potentially suffocate if a standard bib (unsecured around the sides) covers their mouth and/or nose. Standard bibs also hinder the baby's sight while crawling as they flap in front of the child's face. The present invention in one or more embodiments provides a standard of safety that standard bibs do not.

The bib 10 may be made be generally made of cotton, although the attachment devices 16, 18, 22, and 32 and their stitches and the periphery 12 of the bib 10 may be made of a material other than cotton. The periphery 12 of the bib 10 may be made of a polyester binding. The front surface 14*a* of the bib 10 shown in FIG. 1 may be made of cotton or a vinyl backing. The rear surface 14*b* of the bib 10 shown in FIG. 2 may be made of cotton or a vinyl backing. The vinyl backing prevents moisture from penetrating the bib 10 as well as for example a baby's clothing.

The height, D5, of the extension 20, and the height D6 of the extension 30 may be three and one-half inches or may be about half of the body portion 11*b* length D7, which may be seven inches. The dimensions D5 and D6 may be greater than the length D7. Having a large dimension for D5 and D6, relative to the body portion 11*b* length D7, inhibits any substantial part of the bib 10 from flapping freely, after the extensions 20 and 30 are attached together.

Although the invention has been described by reference to particular illustrative embodiments thereof, many changes and modifications of the invention may become apparent to those skilled in the art without departing from the spirit and scope of the invention. It is therefore intended to include within this patent all such changes and modifications as may reasonably and properly be included within the scope of the present invention's contribution to the art.

I claim:

1. An apparatus comprising a bib comprised of:

a neck portion;

a body portion having a length;

a device for securing the neck portion around an individual's neck; and and a device for securing the body portion around an individual's torso;

wherein the device for securing the body portion around an individual's torso includes a first extension and a second extension;

wherein the first extension extends outward from the body portion a first distance and the second extension extends outward from the body portion a second distance;

wherein the first extension has a height, which runs parallel to the length of the body portion when the body portion is secured, and which is about half the length of the body portion and the second extension has a height, which runs parallel to the length of the body portion when the body portion is secured, and which is about half the length of the body portion, wherein the first extension and the second extension each include an attachment device;

wherein the attachment device of the first extension is disposed along a majority of the height of the first extension;

wherein the attachment device of the second extension is disposed along a majority of the height of the second extension; and wherein the attachment device of the first extension includes loops and the attachment device of the second extension includes hooks.

2. An apparatus comprising a bib comprised of:

a neck portion;

a body portion having a length;

a device for securing the neck portion around an individual's neck; and and a device for securing the body portion around an individual's torso;

wherein the device for securing the body portion around an individual's torso includes a first extension and a second extension;

wherein the first extension extends outward from the body portion a first distance and the second extension extends outward from the body portion a second distance;

wherein the first extension has a height, which runs parallel to the length of the body portion when the body portion is secured, and which is about half the length of the body portion and the second extension has a height, which runs parallel to the length of the body portion when the body portion is secured, and which is about half the length of the body portion;

wherein the length of the body portion is about seven inches;

wherein the first extension and the second extension each include an attachment device;

wherein the attachment device of the first extension is disposed along a majority of the height of the first extension;

wherein the attachment device of the second extension is disposed along a majority of the height of the second extension; and wherein the attachment device of the first extension includes loops and the attachment device of the second extension includes hooks.

3. A method comprising the steps of:

securing a neck portion of a bib to an individual's neck;

securing a body portion, having a length, of a bib to an individual's torso;

wherein the step of securing the body portion of the bib to an individual's torso comprises:

attaching a first extension connected to the body portion to a second extension connected to the body portion;

wherein the first extension extends outward from the body portion a first distance and the second extension extends outward from the body portion a second distance;

wherein the first extension has a height, which runs parallel to the length of the body portion when the body portion is secured, and which is greater than about half the length of the body portion and the second extension has a height, which runs parallel to the length of the body portion when the body portion is secured, and which is greater than about half the length of the body portion;

wherein the first extension and the second extension each include an attachment device;

wherein the attachment device of the first extension is disposed along a majority of the height of the first extension;

wherein the attachment device of the second extension is disposed along a majority of the height of the second extension; and wherein the step of securing the body portion includes attaching the attachment device of the first extension to the attachment device of the second extension.

4. The method of claim 3 wherein the attachment device of the first extension includes loops and the attachment device of the second extension includes hooks;

and the step of securing the body portion of the bib to an individual's torso includes connecting the loops of the attachment device of the first extension with the hooks of the attachment device of the second extension.

* * * * *